US005526941A

United States Patent [19]

Ford

[11] Patent Number: 5,526,941

[45] Date of Patent: Jun. 18, 1996

[54] SUSPENDER DISPLAY FIXTURE

[76] Inventor: Allan L. Ford, 7618 Lycoming Ave., Melrose Park, Pa. 19126

[21] Appl. No.: 221,134

[22] Filed: Mar. 31, 1994

[51] Int. Cl.[6] ..... A47F 7/00

[52] U.S. Cl. ..... 211/59.1; 211/60.1; 211/103; 211/106

[58] Field of Search ..... 211/60.1, 59.1, 211/57.1, 106, 103, 163, 113

[56] References Cited

U.S. PATENT DOCUMENTS

| | | | |
|---|---|---|---|
| 2,665,869 | 1/1954 | Samuels | 211/59.1 X |
| 3,973,678 | 8/1976 | Nesbitt | 211/106 |
| 4,027,799 | 6/1977 | Stucker | 211/106 |
| 4,344,540 | 8/1982 | Marschak | 211/106 |
| 4,591,057 | 5/1986 | Garfinkle | 211/106 X |
| 4,606,466 | 8/1986 | Fredrickson | 211/59.1 |
| 4,759,440 | 7/1988 | Kolton et al. | 211/113 X |
| 4,863,020 | 9/1989 | Klemow | 211/60.1 X |
| 4,940,146 | 7/1990 | Kolton et al. | 211/113 |
| 5,303,830 | 4/1994 | Metcalf | 211/59.1 X |

*Primary Examiner*—Robert W. Gibson, Jr.
*Attorney, Agent, or Firm*—Caesar, Rivise, Bernstein, Cohen & Pokotilow Ltd.

[57] ABSTRACT

A suspender display fixture comprising a supporting bar and a plurality of rods supported by and projecting horizontal from said bar. Each rod has indicia associated therewith, with said indicia comprising a number. A plurality of hang tags for suspending suspenders from the rods are provided, with each hang tag having a pair of suspenders placed thereon. Indicia are associated with each pair of suspenders, with said indicia bearing a number. The number on the suspenders is the same as the number associated with the rod from which the suspenders are suspended. The number coding system permits segregation of the suspenders by color, style or material from which they are made. This invention further encompasses a suspender display fixture comprising a plurality of horizontal bars and a plurality of parallel rods secured to and projecting horizontally outwardly from said bars. The bars are vertically spaced on supporting members, with each bar being positioned horizontally outwardly from said supporting members a greater distance than the bar immediately above it.

12 Claims, 4 Drawing Sheets

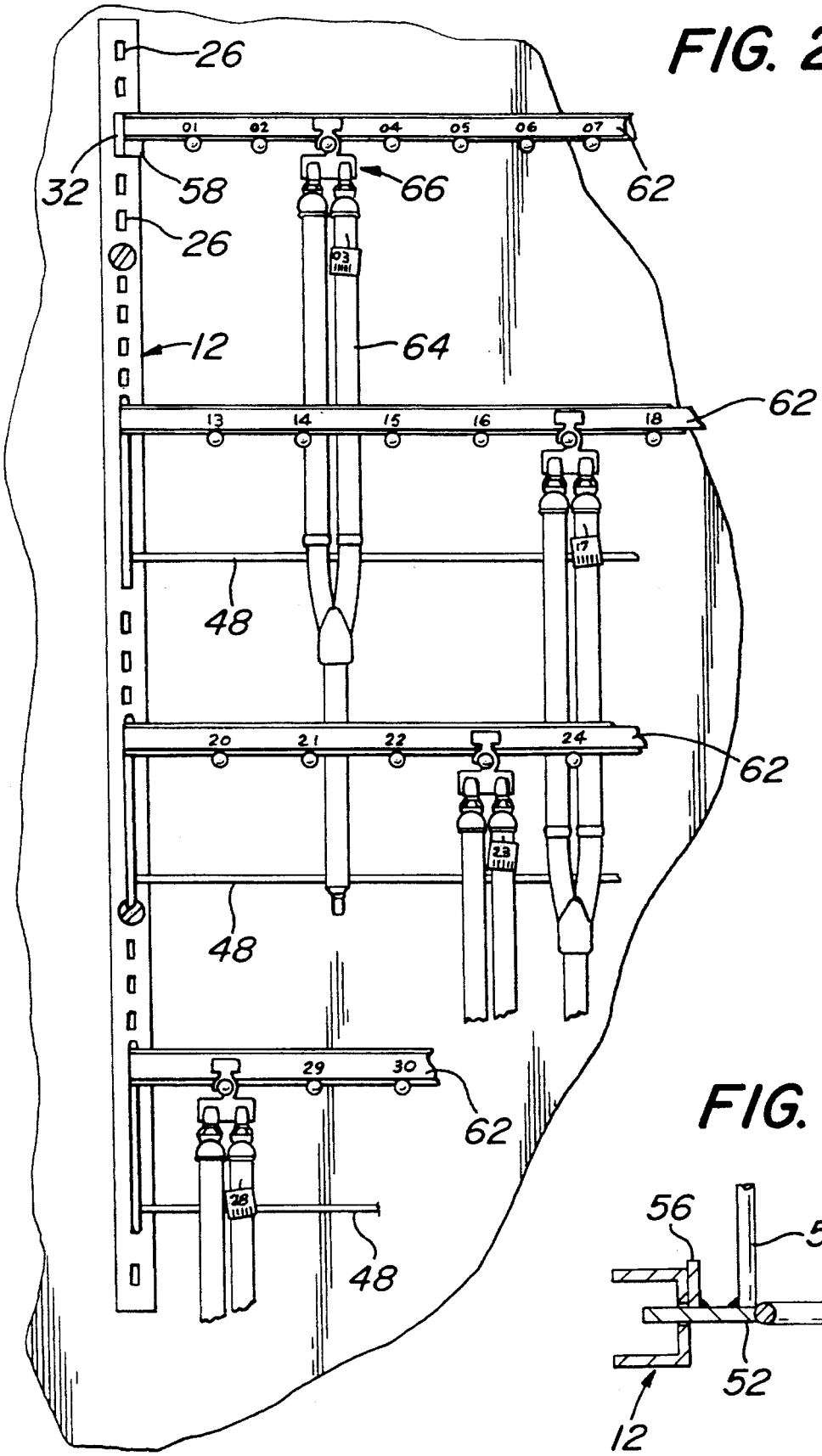
FIG. 2
FIG. 4
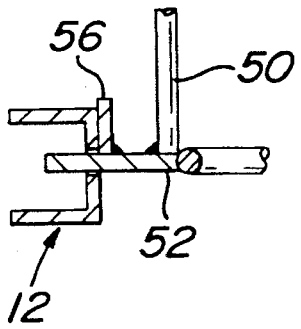

SUSPENDER DISPLAY FIXTURE

Be it known that I, Allan L. Ford, a citizen of the United States of America, residing in Melrose Park, County of Montgomery, Commonwealth of Pennsylvania, have made a certain new and useful invention in a Suspender Display Fixture, of which the following is a specification.

BACKGROUND OF THE INVENTION

This invention relates generally to a display fixture, and more particularly, to a fixture used for displaying and vending suspenders.

Suspenders are commonly vended by packaging them in boxes with transparent fronts, through which they are visible, or by suspending them from display racks. The advantage of displaying them on a rack, as opposed to packaging them in boxes, is that a customer can view and feel a substantial portion of the suspenders, without the necessity of removing them from a box. When they are removed from a box, the customer may not necessarily replace them in the box, when placing the box back on a counter.

One of the problems of utilizing the racks presently in use is that there is no method or mechanism for separating suspenders by color, design, materials from which they are made, etc. Thus, generally, because of the lack of any segregation method, all different types and styles of suspenders are comingled on the display rack. This results in excessive handling by customers, and the soiling or damaging of the suspenders when a customer has to move the suspenders in front in order to view the suspenders in the rear of the display rack.

When a store tries to segregate styles or colors of suspenders on specific rods on a display rack, it is difficult for the store to maintain the separation of the suspenders. Thus, quite often the customers will remove a pair of suspenders from a particular supporting rod, and replace the suspenders on a different rod. This creates a major problem for a store that is attempting to maintain inventory of given colors and styles and, in addition, prevents a customer from noticing that a particular color or style is available, since he will only look at suspenders on the supporting rods of the rack containing the color or style that he is looking for.

Applicant recognized a similar problem in connection with the displaying and vending of belts, and solved the problem through the use of a color coding system for the display of belts. In this system, a display rack for the belts had a plurality of sections. Each section was coded with a specific color. Each section had a plurality of spokes, and belts were suspended from the spokes by hang tags. The hang tags had the same color as the color of the section on which the belts were to be hung. Utilizing the color coding system, all of the belts of a particular style were hung in the same section, and were easily segregated by matching the colors. This color coding system is described in detail in U.S. Pat. No. 4,253,576.

When Applicant recognized that there was a similar problem in connection with the display and vending of suspenders, consideration was given to utilizing a color coding system similar to that of U.S. Pat. No. 4,253,576. However, there are only a limited number of colors available, and there are a far greater number of styles, colors and materials used with suspenders. Any attempt to distinguish the suspenders by color gradients could defeat the purpose of the colors, since a stock clerk is not always attentive to color variations, and the net result could be that when a clerk adds to the inventory of a display rack or reorganizes a display rack when some of the suspenders are misplaced by a customer, misplacing could still result.

The problem of accurately separating suspenders is solved by this invention. The display rack of the invention has a plurality of rods for supporting suspenders. A different number is associated with each rod and the corresponding number is placed on the suspenders adapted to be supported by the rod. In this way, an endless number of styles, colors or materials of suspenders can be accommodated by the display rack, with the suspenders being accurately placed in the appropriate location, with a minimal amount of attention required by the person stocking the display rack.

In another aspect of this invention, the display rack supporting the suspenders is constructed in a manner that will maximize the number of suspenders vendable in a given area of floor space. The rack is arranged to have a plurality of tiers of vertically hanging suspenders, with each tier being lower and forwardly placed with respect to the higher tier or tiers. This permits a portion of each pair of suspenders to hang behind the suspenders on the next lower tier.

OBJECTS OF THE INVENTION

It is accordingly an object of this invention to provide a novel suspender display fixture.

It is another object of this invention to provide a suspender display fixture that is adapted to separate suspenders by color, style, material, etc.

It is a further object of this invention to provide a suspender display fixture that maximizes the number of suspenders adapted to be supported by the fixture in a given area of display space.

SUMMARY OF THE INVENTION

These and other objects of this invention are accomplished by providing a suspender display fixture comprising a supporting bar and a plurality of rods supported by and projecting horizontally from said bar. Each rod has indicia associated therewith, with said indicia comprising a number. A plurality of hang tags for suspending suspenders from the rods are provided, with each hang tag having a pair of suspenders placed thereon. Indicia are associated with each pair of suspenders, with said indicia bearing a number. The number on the suspenders is the same as the number associated with the rod from which the suspenders are suspended.

This invention further encompasses a suspender display fixture comprising a plurality of horizontal bars, a plurality of parallel rods secured to and projecting horizontally outwardly from said bars, said bars being vertically spaced on supporting members, with each bar being positioned horizontally outwardly from said supporting members a greater distance than the bar immediately above it.

DESCRIPTION OF THE DRAWINGS

Other objects and many of the attendant advantages of this invention will become readily appreciated as the same becomes better understood by reference to the following detailed description, when considered in connection with the accompanying drawing, wherein:

FIG. 2 is a front elevational view, partially broken away, of the suspender display fixture of FIG. 1, and showing additional pairs of suspenders supported thereon;

FIG. 4 is an enlarged sectional view taken along the line 4—4 of FIG. 3; and,

DETAILED DESCRIPTION OF THE PREFERRED EMBODIMENT

Figure 1:
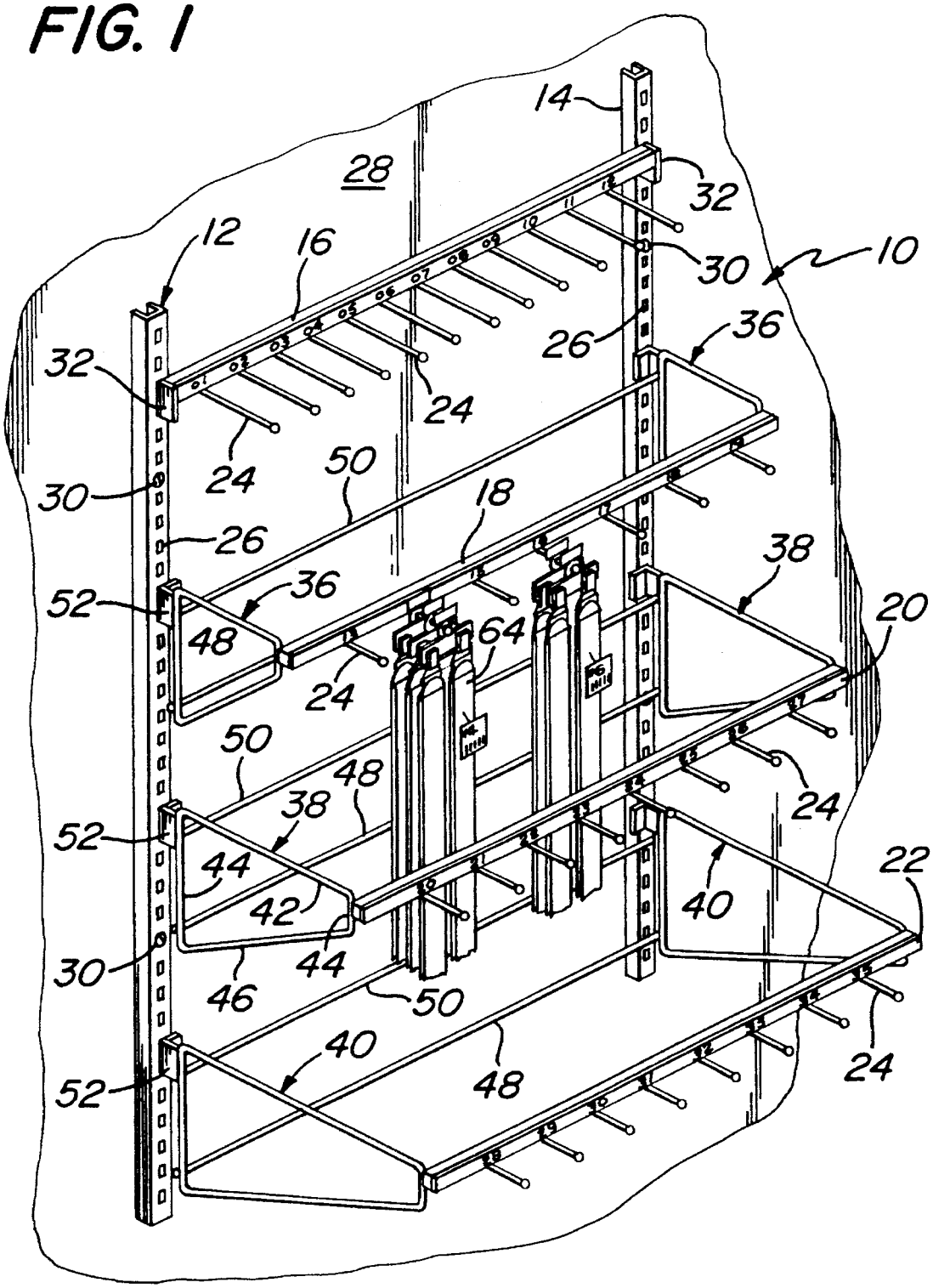
FIG. 1 is a perspective view of the suspender display fixture of this invention.

Referring now in greater detail to the various figures of the drawing, wherein like reference characters refer to like parts, a suspender display fixture embodying the present invention is generally shown at 10 in FIG. 1. Device 10 comprises a pair of vertical standards 12 and 14, bars 16, 18, 20 and 22 supported by the standards and a plurality of rods 24 welded to the undersides of the bars 16, 18, 20 and 22.

Figure 3:
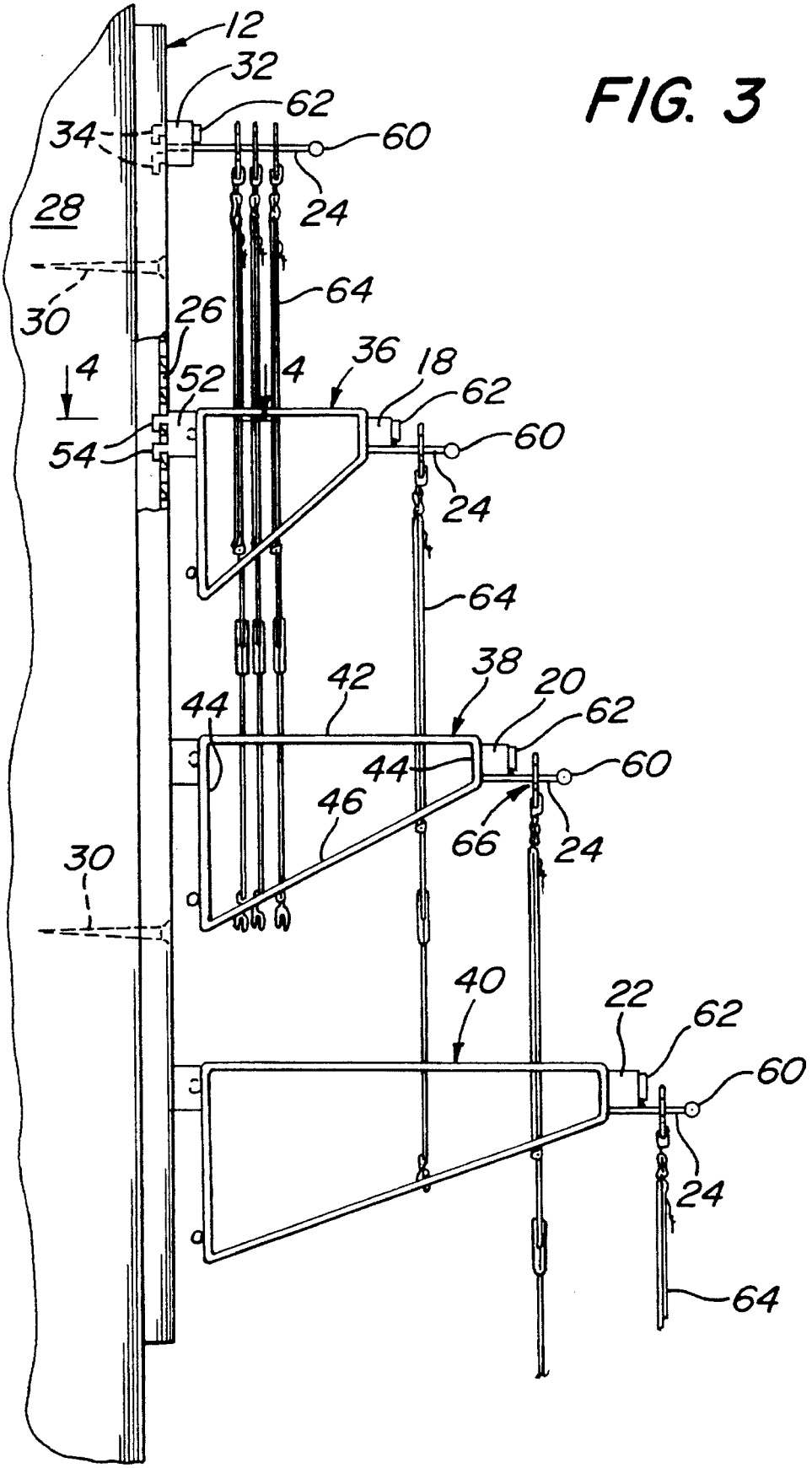
FIG. 3 is a side elevational view of the suspender display fixture of FIG. 2.

Referring to FIGS. 1 and 3, it is seen that standards 12 and 14 are U-shaped bars, and have a plurality of vertically spaced slots 26 formed in the front thereof. The standards are secured against a wall 28 by screws 30. The uppermost bar 16 is mounted on standards 12 and 14 by plates 32, which are secured to bar 16, as by welding. As seen in FIG. 3, each plate 32 includes a pair of angled ears 34.

In assembling the display rack, a pair of ears 34 is inserted into a pair of vertically spaced slots 26 in each of standards 12 and 14. The ears are rotated through the slots, and after complete insertion, are in the position shown in FIG. 3. This securely locks the bar 32 in place.

As seen in FIGS. 1 and 3, bar 18 is mounted on support 36, bar 20 is mounted on support 38 and bar 22 is mounted on support 40. Each of the supports is formed from a rod, and includes an upper horizontal portion 42 (see FIG. 3 with respect to support 38), vertical front and rear portions 44 and an inclined lower portion 46. A rigidifying rod 48 is welded to each pair of supports 36, 38 and 40, and extends horizontally between each pair (see FIGS. 1 and 2). As seen in FIG. 1, a second rigidifying rod 50 is welded to each pair of supports 36, 38 and 40, and extends horizontally between each pair of supports. Bars 18, 20 and 22 are welded to the front portions 44 of their respective supports.

Each support 36, 38 and 40 is welded to a plate 52, which is similar in structure and function to plate 32. As seen in FIG. 3, each plate 52 includes a pair of angled ears 54, which are received in a pair of adjacent slots 26 in standards 12 and 14. As seen in FIG. 4, a tab 56 is welded to plate 52, and projects perpendicularly thereto. When the ears of plates 52 are inserted in standards 12 and 14, the tabs 56 bear against the front faces of the standards and retain the supports 36, 38 and 40 in the positions shown in FIGS. 1 and 3. Similar tabs 58 (one shown in FIG. 2) are secured to plates 32, for the same purpose.

As best seen in FIG. 1, rods 24 are parallel and horizontally spaced, and are welded to the bottoms of their respective bars 16, 18, 20 and 22. Each rod 24 has an enlarged knob 60 at the end thereof. The front of each bar has a strip 62 secured thereon. As seen in FIGS. 1 and 2, strips 62 have a different number positioned over each rod 24. Thus, the numbers 01 to 12 appear on the uppermost strip 62, which numbers correspond to the top twelve rods 24. Similarly, the next lower strip contains numbers 13 to 19, the next lower strip contains numbers 20 to 27, and the lowermost strip 62 contains numbers 28 to 35. The numbers are printed on the strip, although the numbers can be directly applied to the bars, without utilizing the strip.

Figure 5:
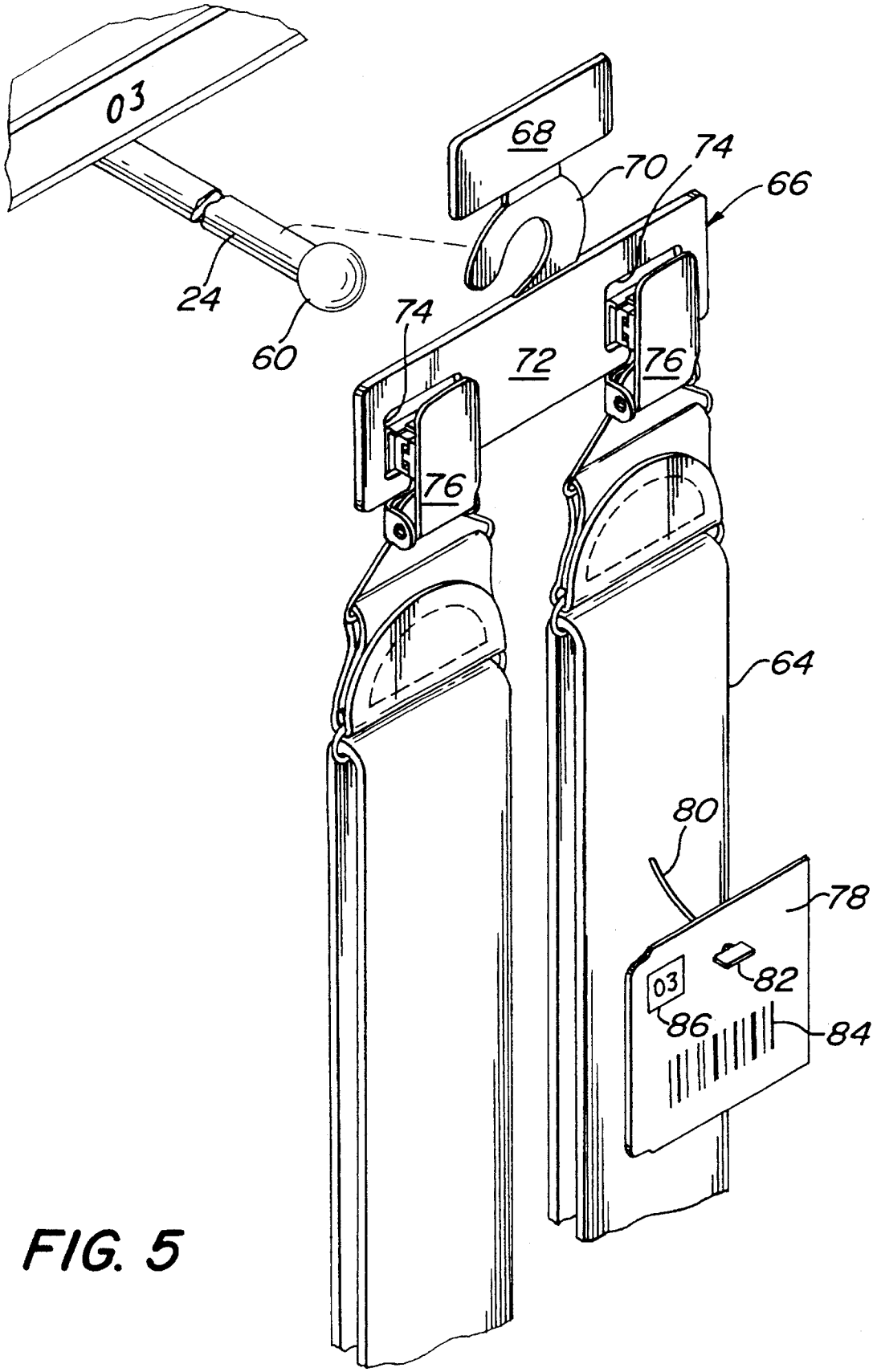
FIG. 5 is an exploded perspective view showing a portion of the display fixture and a pair of suspenders adapted to be placed thereon.

Suspenders 64 are hung from rods 24 through the use of hang tags 66. Hang tags 66 are formed from a rigid plastic, preferably by molding. As best seen in FIG. 5, each hang tag 66 includes a top portion 68, a hook 70 and a suspender holding portion 72. Portion 72 includes a pair of openings 74.

Suspenders 64 are of the type that clamp onto pants. The suspenders are secured to hang tag 66 by closing clamps 76 in openings 74. An identification tag 78 is secured to each pair of suspenders by a conventional plastic filament 80. Filament 80 has enlarged tabs 82 (one shown in FIG. 5) which secure the filament to the suspenders and prevent the tag 78 from being removed.

Tag 78 can have various items of printed material thereon, such as the style number, the inventory number and the price of the suspenders. A UPC symbol 84 can also be printed thereon. A segregating number 86 is also printed on the tag.

In use, the suspenders are hung from rods 24. The hooks of hang tags 66 are placed over the rod, by grasping the top portions 68 of the hang tags and sliding the hooks in place. When the hang tags are on the rods, the knobs 60 prevent the hang tags from sliding off the front of the rods.

The suspenders are segregated on the rods 24 by color, style, material, etc. For instance, if solid color black suspenders are to be vended, all of them can be placed on the third rod, which bears the number 03 (see FIG. 5). The number on the identification tag 78 also bears the number 03. Accordingly, when stocking the fixture 10, all suspenders marked with the number 03 are placed on the rod bearing the number 03. In a similar manner, the numbers on each pair of suspenders are used for locating the proper position for the suspenders on the display fixture.

The fixture is arranged to have the greatest number of rods 24 on the uppermost bar 16. The most popular colors, styles or materials are placed on the upper bar 16, since these are the suspenders that will appear at the eye level of the prospective purchaser. Additionally, the rods 24 secured to the upper bar 16 are twice the length of the rods on the lower bars. This permits to have twice the amount of inventory on the upper rods as can be placed on any of the lower rods.

When a customer desires to purchase suspenders, all of the suspenders in the color, style or material that the customer desires can be found on a single rod, or on a group of rods. It will not be necessary for the customer to look through the suspenders on all 35 rods in order to find a particular color, style or material. For instance, if a customer is seeking suspenders made from a silk fabric, in a foulard pattern, and in a predominantly blue color, all suspenders of this type can be located on a single rod, which will facilitate the customer's finding the desired suspenders. This obviates the necessity of handling all of the suspenders on the other rods, thereby preventing the soiling or damaging of the other suspenders.

Using the number-matching system of this invention, a clerk can easily re-stock the display fixture and re-organize the display fixture, if any of the suspenders were moved by the customers. All the clerk need do is match the number on the identification tag with the number adjacent the rod. Because there are so many different rods on the display fixture, the color coding system of U.S. Pat. No. 4,253,576 does not lend itself to carrying out this invention. Thus, there are only a limited number of different colors, and it would be necessary to attempt to have different shades of a given color to try and match suspenders by color. Since the shades might not be perfect matches, when new identification tags are printed, this could create a major problem for the stocking clerk. If he is unable to readily distinguish between the colors, the display would not accurately segregate the suspenders. This problem does not arise when using the number-matching system of this invention. The stocking clerk can readily identify the matching numbers.

Although the device of this invention has been shown in connection with suspenders having clamps, it can also be used in connection with suspenders that are held on pants by buttons. In this case, rather than having clamps at the ends of the suspender straps, the straps have a loop, and a securing band passes through the loop. The securing band has a button hole at each end. Suspenders can be placed on the hang tags by overlapping the button holes, inserting the ends of the band into the opening and placing a stud that is positioned in the opening through the button holes. On other hang tags used with button-on suspenders, plastic buttons are formed on the front face of the hang tags, and the suspenders are suspended by the hang tags by the insertion of the buttons into the button holes. Other means can be used for hanging suspenders, whether they have clamps or button straps, from the hang tags, in a manner well known in the art.

As best seen in FIG. 3, the bar for each tier of rods 24 projects outwardly a greater distance than the next higher bar. Accordingly, when the suspenders are placed on the rods 24, the upper suspenders pass behind the lower suspenders. This permits the display of a substantial number of different suspenders on the display rack, whereby a greater number of different suspenders is readily visible to the customer, without the necessity of moving suspenders. As seen in FIG. 2, a sufficient portion of each pair of suspenders is visible above the next lower bar to have the customer readily determine the nature of the suspenders, without having to move any of the suspenders.

Although the invention has been shown through the use of standards 12 and 14 secured on a wall, any supporting structure can be used in carrying out this invention. Thus, the bars 16, 18, 20 and 22 can be supported by free standing vertical bars. A second set of bars and rods can be placed on the opposite side of the vertical bars, where the vertical bars are free standing.

Without further elaboration, the foregoing will so fully illustrate this invention that others may, by applying current or future knowledge, readily adapt the same for use under various conditions of service.

I claim:

1. A suspender display fixture comprising a bar, means for supporting said bar in a horizontal position, a plurality of rods supported by and projecting horizontally from said bar, each rod having first indicia associated therewith, with each first indicium comprising a different first number, a plurality of hang tags for suspending suspenders from said rods, each hang tag having a pair of suspenders thereon, each pair of suspenders having indicia bearing means secured thereto, said indicia bearing means comprising second indicia, with each second indicium comprising a different second number, with said second number on one of said suspenders being the same as said first number associated with said rod from which said one of said suspenders is suspended, whereupon said first and second numbers is used to separate said one of said suspenders from others of said suspenders according to its color, style or the materials from which it is formed.

2. The fixture of claim 1 wherein said first indicia are placed on said bar, with each first indicium being aligned with a corresponding rod.

3. The fixture of claim 1 wherein said second indicia bearing means comprise respective tags.

4. The fixture of claim 1, and further including a plurality of bars, each of said bars being supported in a horizontal position on said supporting means, with each of said bars having a plurality of rods secured thereto and projecting horizontally outwardly therefrom, each rod of said plurality of bars having said first indicia associated therewith.

5. The fixture of claim 4 wherein all of said bars are parallel and vertically spaced on said supporting means, with each bar being positioned horizontally outwardly from said supporting means a greater distance than the bar immediately above it.

6. The fixture of claim 4 wherein a greater number of rods is secured to the uppermost bar than are secured to the bars below the uppermost bar.

7. The fixture of claim 4 wherein the length of the rods on the uppermost bar is greater than the length of the rods on the bars below the uppermost bar.

8. The fixture of claim 1 wherein the supporting means comprises a pair of standards, said standards having vertically spaced slots formed therein, and said bar is secured to said standards by securement means secured to said bar, and having portions thereof received in at least one of said slots in each of said standards.

9. In combination a suspender display fixture and plural suspenders, said plural suspenders comprising a first group of most popular suspenders, and a group of less popular suspenders, each of said suspenders being mounted on a respective hang tag, said display fixture comprising supporting means, a plurality of horizontal bars supported by said supporting means, a plurality of parallel rods secured to and projecting horizontally outwardly from each of said bars, said bars being parallel and vertically spaced on said supporting means, with each bar being positioned horizontally outwardly from said supporting means a greater distance than the bar immediately above it, said uppermost bar having a greater number of rods secured thereto than are secured to said bars below said uppermost bar, with said first group most popular suspenders being suspended from said uppermost bar, while said bars disposed therebelow have a lesser number of rods secured thereto, with said second group of less popular suspenders suspended from said lesser number of rods of said bars below said uppermost bar.

10. The fixture of claim 9, and further including supports connecting said bars to said supporting means, said supports varying in length, to establish the horizontal position of each bar relative to the other bars.

11. The fixture of claim 9 wherein the length of said rods on said uppermost bar is greater than the length of said rods on said bars below said uppermost bar.

12. A suspender display fixture comprising supporting means, a plurality of horizontal bars supported by said Supporting means, a plurality of parallel rods secured to and projecting horizontally outwardly from each of said bars, and a plurality of supports, said bars being parallel and vertically spaced on said supporting means, with each bar being positioned horizontally outwardly from said supporting means a greater distance than the bar immediately above it, said supports connecting said bars to said supporting means, said supports varying in length, to establish the horizontal position of each bar relative to the other bars, said uppermost bar being secured directly to the supporting means, and said other bars being supported by said supports.

* * * * *